US005263235A

United States Patent [19]

Duncan et al.

[11] Patent Number: 5,263,235

[45] Date of Patent: Nov. 23, 1993

[54] COMPLIANT DRIVE LINK FOR TENTER

[75] Inventors: Jeffrey B. Duncan, Argyle; Alejandro Guevara, Clifton Park, both of N.Y.

[73] Assignee: Albany International Corp., Albany, N.Y.

[21] Appl. No.: 50,769

[22] Filed: Apr. 21, 1993

Related U.S. Application Data

[63] Continuation-in-part of Ser. No. 920,122, Jul. 24, 1992.

[51] Int. Cl.[5] ..... D06C 3/02

[52] U.S. Cl. ..... 26/89; 26/73; 26/93

[58] Field of Search ..... 26/89, 93, 73, 88, 96, 26/52, 72, 94, 71

[56] References Cited

U.S. PATENT DOCUMENTS

| | | | |
|---|---|---|---|
| 2,923,999 | 2/1960 | Miller | 26/73 |
| 3,123,854 | 5/1964 | Aykanian | 26/73 |
| 3,148,409 | 9/1964 | Bruckner | 26/73 |
| 3,150,433 | 9/1964 | Kampf | 26/73 |
| 3,247,544 | 4/1966 | Bromley | 26/73 |
| 3,491,402 | 1/1970 | Shindo et al. | 26/73 |
| 3,552,248 | 1/1971 | Pernick | 26/73 |
| 3,755,862 | 9/1973 | Molz | 26/73 |
| 3,833,973 | 9/1974 | Schwarz | 26/73 |
| 3,932,919 | 1/1976 | Hutzenlaub | 26/73 |
| 4,637,103 | 1/1987 | Hutzenlaub | 26/73 |

FOREIGN PATENT DOCUMENTS

| | | | |
|---|---|---|---|
| 23367 | 7/1962 | Fed. Rep. of Germany | 26/73 |

*Primary Examiner*—Clifford D. Crowder
*Assistant Examiner*—Amy Brooke Vanatta
*Attorney, Agent, or Firm*—Kane, Dalsimer, Sullivan, Kurucz, Levy, Eisele & Richard

[57] ABSTRACT

A tentering machine having a compliant drive link allows for a considerable rate of stretch in a tentered fabric, web or film without the distortion or bowing frequently observed with the tentering machines of the prior art. The tentering machine includes two conveyor tracks adjacent to and facing one another, each conveyor track having a number of fabric edge holders slidingly directable thereabout. A fabric, web or film, grasped on opposite edges by the fabric edge holders, is conveyed thereby through the tentering machine in the space between the two conveyor tracks. Widthwise stretching occurs where the conveyor tracks of the tentering machine have sections on each side of the fabric which diverge from one another, while the two conveyor tracks may be parallel to each other on the two sides of the fabric in applications where prevention of shrinkage is of interest. The fabric edge holders on each conveyor track are run at a substantially common speed by drive chains. Elongated, spring-like compliant drive links extend from the drive chains to the fabric edge holders, but are not connected thereto. The compliant drive links allow adjacent fabric edge holders to move relative to one another, permitting a considerable rate of stretch without the distortion or bowing of the fabric, web or film observed during the use of prior-art tentering machines.

11 Claims, 6 Drawing Sheets

COMPLIANT DRIVE LINK FOR TENTER

This is a continuation-in-part of copending application Ser. No. 07/920,122 filed on Jul. 24, 1992.

BACKGROUND OF THE INVENTION

1. Field of the Invention

The present invention relates to a machine used to stretch, or tenter, a fabric, web or film in a direction transverse to that in which it is being conveyed through a treatment zone, such as a process oven, or to prevent the fabric, web or film from shrinking in a transverse direction as it is being conveyed through such a zone. Specifically, the present invention is a tentering machine which includes means for reducing or eliminating longitudinal distortion during tentered processing.

2. Description of the Prior Art

Tentering machines are well known in the art. Generally, these machines include pin-plates or clamps which grasp the opposite edges of the fabric, web or film to be stretched in a widthwise, or transverse direction, or to prevent their shrinking in such a direction.

The pin-plates or clamps may convey the fabric through a stretching, or tentering, zone, where they, while grasping opposite edges of the fabric, are conveyed along divergent tracks. Both before and after the tentering zone, the pin-plates or clamps on opposite sides of the fabric may proceed in parallel directions. Alternatively, the pin-plates or clamps may be conveyed only along parallel tracks so that they may prevent shrinkage from occurring in a treatment zone.

The pin-plates or clamps are driven about a pair of endless-loop paths which are adjacent to and face one another. In the tentering machines of the prior art, they are commonly attached firmly to a drive chain, which may describe an endless-loop path within that followed by the pin plates or clamps.

The tentering zone, then, is between the pair of endless-loop paths around which the pin-plates or clamps are conveyed. Initially, those on each endless-loop path grasp the opposite edges of the fabric to be tentered and may be conveyed in directions parallel to one another. In the tentering zone, they may proceed along divergent paths stretching the fabric in a widthwise direction while conveying the fabric longitudinally therethrough, or they may remain travelling in parallel directions simply to prevent shrinkage. Finally, upon exiting from the tentering zone, they may again be conveyed in directions parallel to one another, if they have diverged, before releasing the fabric.

If the fabric, web or film elongates in a direction parallel to its motion while tentered, the rigid spacing between adjacent pin-plates or clamps in prior-art tentering machines, where they are firmly attached to the drive chain, may permit distortion. Some manufacturers have attempted to overcome this disadvantage by attaching the pin-plates or clamps to the drive chain using drive pins in slotted holes, but this limits the web elongation to the length of the slot. In addition, web driving force is lost when the drive pin leaves the end of the slot.

Other manufacturers have added springs to the drive slot to maintain drive force, but such an expedient limits web elongation even more seriously.

The present invention supplies a solution to these disadvantages in the tentering machines of the prior art by including means whereby pin-plates or clamps may be driven from a chain in a manner which permits considerable web elongation without loss of driving force. In addition, the means of the present invention permits the direction of motion of the entire line to be reversed without modification or loss of function.

SUMMARY OF THE INVENTION

The present invention provides a means for driving the pin-plates or clamps in a tentering machine while allowing for a considerable rate of stretch in the tentered fabric, web or film.

In its broadest form, the present invention is a tentering machine for conveying a fabric, web or film through a treatment zone and either stretching it in a widthwise direction, transverse to that in which said fabric, web or film is being conveyed through said tentering machine, or preventing it from shrinking in that direction.

The tentering machine includes a first conveyor track and a second conveyor track, which take the form of endless closed loops adjacent to and facing each other between which the fabric, web or film to be stretched may be conveyed. The first conveyor track may have a section of predetermined length which diverges from a corresponding and facing section on the second conveyor track, or the facing sections of the first conveyor track and the second conveyor track may be parallel to one another for their entire lengths. The first and second conveyor tracks each have a guide means extending around their closed-loop forms.

The tentering machine also includes a first plurality of fabric edge holders and a second plurality of fabric edge holders. Each fabric edge holder includes an edge holding means, means for engaging with the guide means on the first or second conveyor tracks, and means for being driven around the first or second conveyor track. The first plurality of fabric edge holders is disposed on the first conveyor track, and the second plurality of fabric edge holders is disposed on the second conveyor track. Each fabric edge holder is slidingly directable about its respective conveyor track. The means for engaging with the guide means on the first or second conveyor track on each fabric edge holder fits into and cooperates with the guide means to direct the fabric edge holders around their respective conveyor tracks.

The tentering machine further includes a first drive means and a second drive means. The first drive means is associated with the first conveyor track and the second drive means is associated with the second conveyor track. Each drive means is operable to drive the first and second pluralities of fabric edge holders about their respective conveyor tracks at a common speed.

The first and second drive means each have a plurality of elongated resilient, spring-like means extending therefrom for a predetermined length to an end point for driving individual fabric edge holders of the first and second pluralities of fabric edge holders about their respective conveyor tracks. These resilient, spring-like means act upon the means for being driven on the fabric edge holders, but are not fixedly connected thereto. By extending from the first and second drive means, the resilient, spring-like means drive individual fabric edge holders of said first and second pluralities of fabric edge holders about their respective conveyor tracks, when the first and second drive means are operated.

A specific embodiment of the present invention will now be described in more complete detail, with reference frequently being made to the figures identified as set forth below.

DETAILED DESCRIPTION OF THE PREFERRED EMBODIMENT

Figure 1:
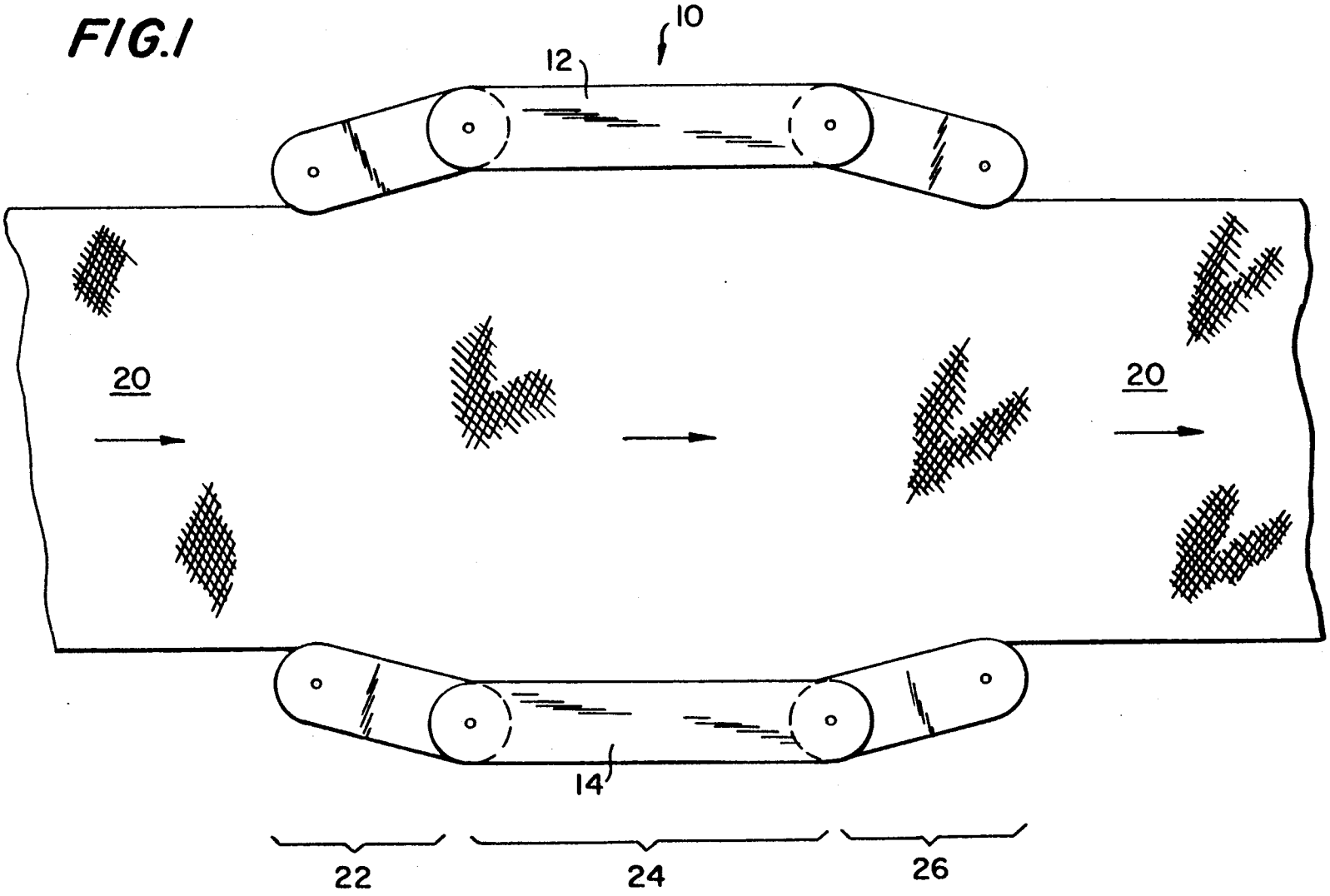
FIG. 1 is a schematic plan view of a tentering machine which may include the compliant drive link of the present invention.

With reference now to the several figures, FIG. 1 presents a schematic plan view of a tentering machine which may include the compliant drive link of the present invention. The tentering machine 10 includes a first tentering means 12 and a second tentering means 14. A fabric 20 is conveyed by the tentering machine 10 through the space between the first tentering means 12 and the second tentering means 14 in the direction of the arrows thereon, or from left to right in FIG. 1. While being so conveyed, the fabric 20 may be stretched in a widthwise direction, that is, in a direction transverse to that in which it is being conveyed through the tentering machine 10.

The first tentering means 12 and the second tentering means 14 each include an endless conveyor track, not shown in FIG. 1, about which a plurality of fabric edge holders are conveyed. The fabric edge holders convey the fabric 20 to be tentered through the space between the first tentering means 12 and the second tentering means 14 by grasping the opposite lateral edges thereof. The fabric edge holders, in turn, are driven about the endless conveyor tracks by endless drive chains which include the compliant drive links of the present invention extending therefrom and engaging the fabric edge holders. The endless drive chains may form an endless loop within the endless conveyor track on each of the first tentering means 12 and second tentering means 14.

In the tentering machine 10 shown in FIG. 1, the first tentering means 12 and the second tentering means 14 each include three corresponding sections. In the first, or inlet, section 22, the first tentering means 12 and the second tentering means 14 diverge from one another. Once the fabric 20 is picked up in the inlet section 22, this divergence either stretches the fabric 20 in a widthwise direction, or simply places it under a tension sufficient to render it taut between the first tentering means 12 and the second tentering means 14.

Having been conveyed through the input section 22, the fabric 20 enters the treatment section 24. As shown in FIG. 1, the first tentering means 12 and the second tentering means 14 are parallel to one another in the treatment section 24, and prevent the fabric 20 from shrinking in a widthwise direction during the heating or other treatment applied thereto in that section.

Finally, after being treated in some fashion, the fabric 20 enters the outlet section 26. As shown in FIG. 1, the first tentering means 12 and the second tentering means 14 converge toward one another in the outlet section 26. This convergence reduces the tension widthwise across the fabric 20, so that it may be easily removed from the tentering machine 10 at the end of the outlet section 26.

Figure 2:
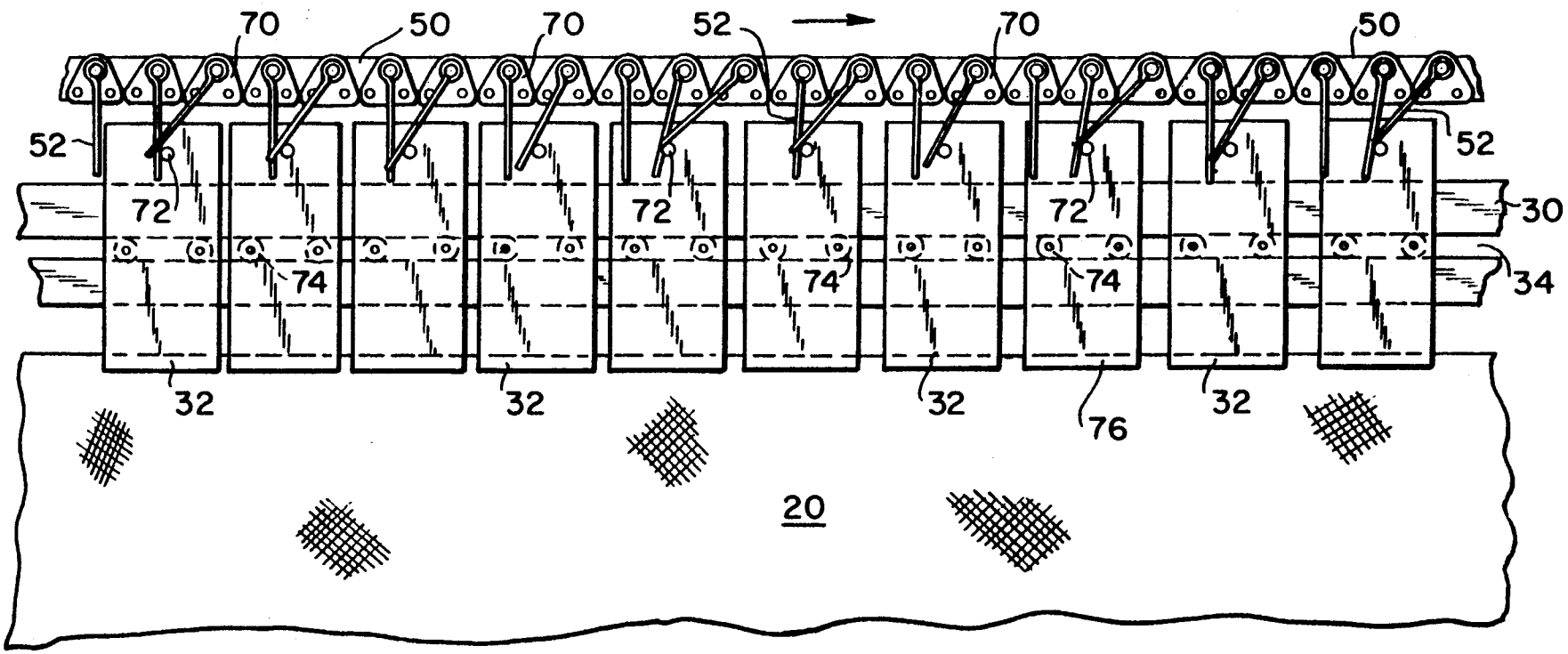
FIG. 2 is a detailed and enlarged plan view of a portion of a tentering machine showing the compliant drive link thereof.

Turning now to FIG. 2, one is presented with a detailed and enlarged plan view of a portion of the tentering machine 10 of the present invention showing the compliant drive link 52 thereof. Specifically, the portion shown is a portion of the first tentering means 12. A portion of a conveyor track 30, and a portion of a drive chain 50, including several chain links 70, are shown. From a plurality of chain links 70, elongated compliant drive links 52 extend toward projecting members 72 extending upward from fabric edge holders 32.

The fabric edge holders 32 are depicted in FIG. 2 as being substantially flat plates. As implied in the preceding paragraph, a projecting member 72 is on the top surface of each fabric edge holder 32. On the bottom surface of each fabric edge holder 32 are two cam-followers 74 projecting downwardly therefrom into endless guide slot 34, by which means the fabric edge holder 32 is guided about conveyor track 30.

As shown in FIG. 2, each fabric edge holder 32 is driven in the direction of the motion of the drive chain 50 by a compliant drive link 52. The drive chain 50 is moving from left to right in FIG. 2, as indicated by the arrow. The compliant drive links 52, in turn, move fabric 20 from left to right through their contact with fabric edge holders 32. Without the compliant drive link mechanism, frictional drag along guide slot 34 would cause distortion near the edges of the fabric 20 being tentered. The compliant drive links 52, designed as leaf springs, apply sufficient force to each fabric edge holder 32 to overcome friction in the guide slot 34. It may be readily observed that, should the need arise, the drive chain 50 and fabric 20 may be driven in either direction. When reversed, the compliant drive links 52 engage with the projecting member 72 on the top surface of the next fabric edge holder 32 in line.

If and when the fabric 20 stretches lengthwise during tentering, the separation between adjacent fabric edge holders 32 is permitted to increase by the design of the present invention. This eliminates the distortion or bowing of the fabric commonly observed during the use of prior-art tentering machines. The compliant drive links 52 permit increased fabric edge holder 32 spacing. The compliant drive link 52 force may be selected by varying the spring constant of the compliant drive link 52.

Where there is a considerable amount of lengthwise stretching in the tentered fabric 20, the present invention permits a fabric edge holder 32 to overrun one compliant drive link 52 and to be picked up by the next compliant drive link 52 in line. This may be seen in FIG. 2 in fabric edge holder 76, one compliant drive link 52 is about to slip over projecting member 72 because of the separation between fabric edge holder 76, and the one to its right. However, should this occur, fabric edge holder 76 will continue to be driven by the next compliant drive link 52 in line.

In short, in order for the spacing between adjacent fabric edge holders 32 to change in response to elongation of the tentered fabric 20, a force exceeding that due to static friction in the guide slot 30 must be provided. In the absence of the compliant drive link, when an adequate force is present, the spacing between fabric edge holders 32 increases suddenly and jerkily until it is halted by tension in the fabric 20. This results in the fabric 20 being processed in a highly erratic manner. The compliant drive link 52 of the present invention permits smooth fabric elongation over the design range, while retaining the ability to operate in either direction, and to tolerate and recover from system jams. It also provides a simplicity of design which keeps fabrication and maintenance costs low.

The compliant drive line 52 force may also be varied, or adjusted, during fabric processing by moving the drive chain 50 relative to the conveyor track 30. Specifically, by varying the distance by which the drive chain 50 is separated from the conveyor track 30, the leverage applied by the compliant drive links 52 to the projecting members 72 on the fabric edge holders 32 may be varied. The smaller the separation, the greater will be the leverage.

Figure 5:
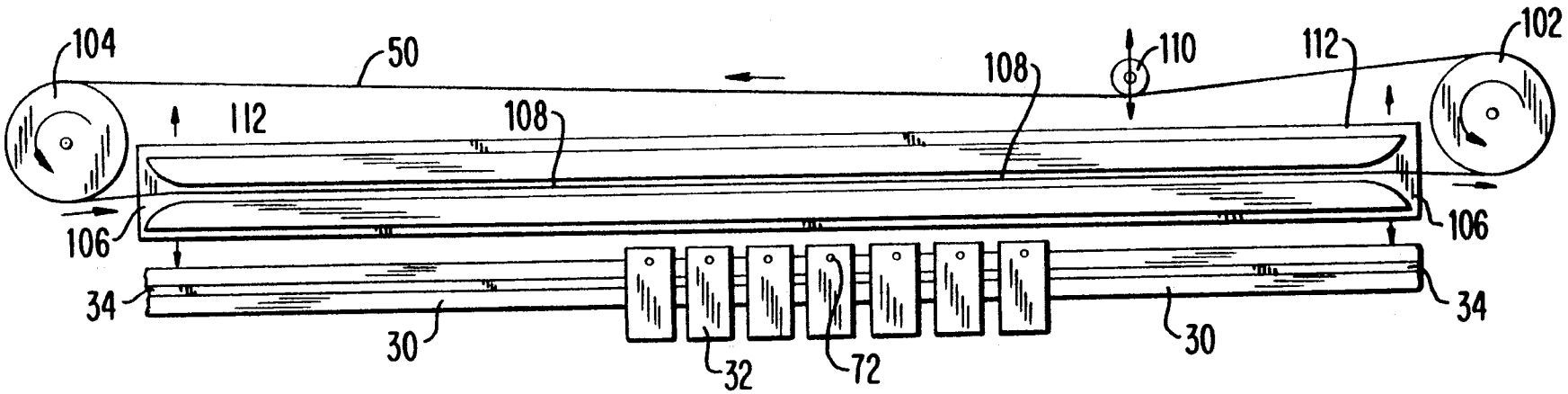
FIG. 5 is a schematic view of a chain positioner, which may be included in the tentering machine of the present invention.

A means by which this separation may be varied is shown in FIG. 5, which shows, in a schematic view, a portion of a conveyor track 30 having an endless guide slot 34. Several fabric edge holders 32, each having a projecting member 72, are disposed on the conveyor track 30.

For the sake of simplicity and clarity, chain links 70 and compliant drive links 52 are not shown in FIG. 5. Drive chain 50, however, is disposed around and extends between a driver sprocket 102 and an idler sprocket 104, the former of which is positively driven to set the drive chain 50 in motion. A portion of the drive chain 50 extends substantially parallel to the conveyor track 30.

On that portion of the drive chain 50, which is also closest to the conveyor track 30, a chain positioner 106, having a longitudinal channel 108 through which the drive chain 50 is constrained to pass, is disposed and is also substantially parallel to the conveyor track 30. The chain positioner 106 is movable relative to the conveyor track 30, so that the distance separating it from the conveyor track 30 may be changed. The drive chain 50 itself, constrained to run through the channel 108 of the chain positioner 106, is in this way moved toward or away from the conveyor track 30, as desired, so as to change the effective length of the compliant drive links 52 extending therefrom, the effective length being the length along a compliant drive link 52 from the drive chain 50 to the point which contacts projecting member 72 on a fabric edge holder 32. A movable tensioner sprocket 110 may be used to remove any slack in the drive chain 50, once the chain positioner 106 has been placed and secured in a desired position.

As suggested by the arrows in FIG. 5, the chain positioner 106, which is of an integral structure, has two ends 112, each of which may be locked into a fixed position. As a consequence, the two ends 112 may be separately moved toward or away from the conveyor track 30, so that the chain positioner 106 may be disposed at either a slight angle to the conveyor track 30, or parallel thereto, at relatively great or small amounts of separation. In this way, the compliant drive link 52 force on a given fabric edge holder 32 may gradually increase or decrease, or remain at a relatively large or small constant value, as it progresses through the tentering machine 10.

Figure 6:
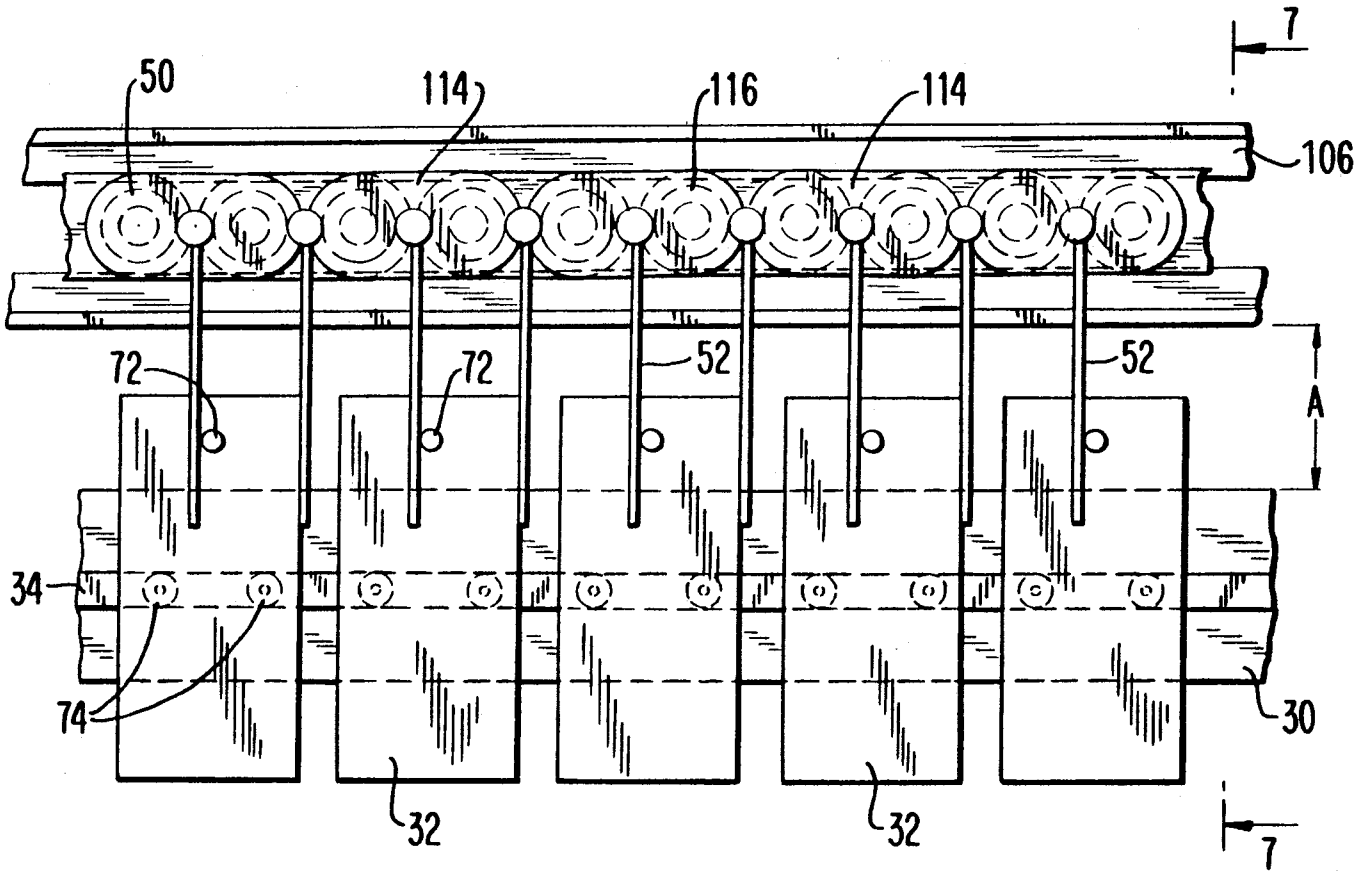
FIG. 6 is a detailed and enlarged plan view of a portion of the tentering machine having a chain positioner shown in FIG. 5.

A more detailed view of a section of chain positioner 106 and conveyor track 30 is given in FIG. 6. The distance "A" between the chain positioner 106 and the conveyor track 30 is that which may be varied by moving the chain positioner 106. As before, fabric edge holders 32 are conveyed upon the conveyor track 30, and are guided therearound by means of cam-followers 74 on their undersides. The cam-followers 74 are inserted into and remain within the endless guide slot 34, which extends around the entire conveyor track 30.

Projecting members 72 extend upward from each fabric edge holder 32. Compliant drive links 52, attached to and extending from the drive chain 50, drive the fabric edge holders 32 through their contact with projecting members 72. The closer the chain positioner 106 is to the conveyor track 30, that is, the smaller "A" is, the smaller is the effective length (length from drive chain 50 to point of contact with projecting member 72) of compliant drive link 52, the greater is the amount of leverage obtained from compliant drive link 52.

The compliant drive link 52 may be attached to the link plates 114, which comprise each link of the drive chain 50, and connect each of its rollers 116 to the next.

Figure 7:
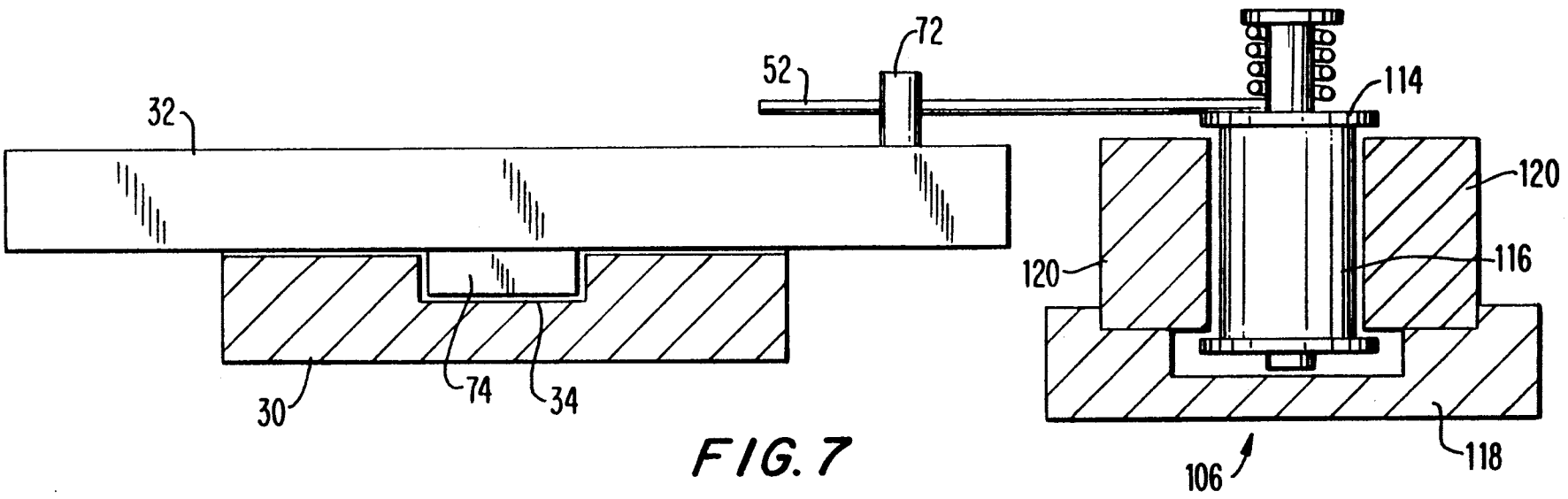
FIG. 7 is a cross-sectional view taken through the conveyor track and chain positioner of the tentering machine taken as indicated by line 7—7 in FIG. 6.

FIG. 7 is a cross-sectional view taken as indicated by line 7—7 in FIG. 6 and showing the chain positioner 106 in greater detail. The chain positioner 106 may comprise a base 118 and two guide bars 120. The rollers 116 of the drive chain 50 are held in an upright position by the guide bars 120, and cannot be twisted from such an orientation by the torque of the compliant drive link 52. Further, the rollers 116 roll between the guide bars 120 of the chain positioner 106 keeping friction low. By moving the chain positioner 106 relative to the conveyor track 30, the effective length of the compliant drive link 52 may be varied, the effective length being measured from the link plate 114 to the point on the compliant drive link 52 which contacts the projecting member 72 on the fabric edge holder 32. The shorter the effective length, the greater the leverage obtained from the compliant drive link 52, and vice versa.

The chain positioner 106 allows one to change the distance separating the drive chain 50 and the conveyor track 30 in response to changing conditions in the web being processed. For example, by decreasing the distance, an increased driving force for correcting web bow or skew which may occur during processing may be obtained without compromising the ability of the tentering machine 10 of the present invention to accommodate web stretch.

Any means my be used to move the chain positioner 106, such as the lead screw, the eccentric, or the scissors. Overall, the fabric edge holders 32 and their conveyor track 30, and the drive chain 50 with its driver sprocket 102, idler sprocket 104 and tensioner sprocket 110 are attached to a common mounting plate. The chain positioner 106 is moved with respect to this common plate to vary the spacing between the drive chain 50 and conveyor track 30.

Figure 3A:
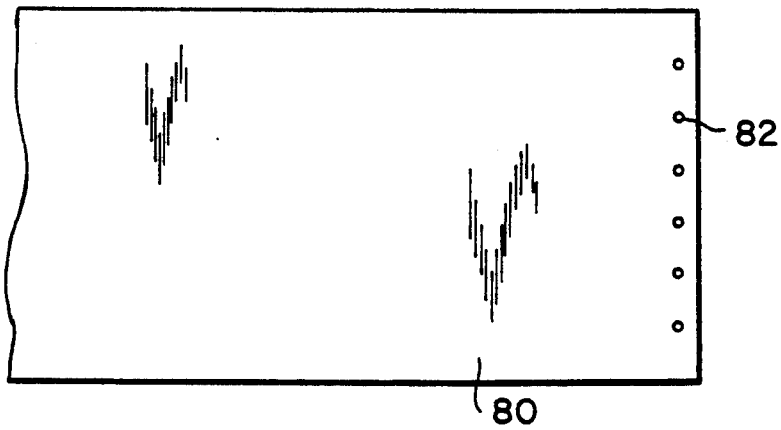
FIG.3A PRIOR ART
FIG. 3A is a plan view of a pin-plate which may be used as the edge holding means on the fabric edge holders of a tentering machine.
Figure 3B:
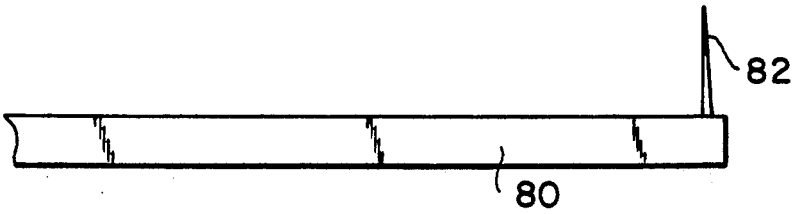
FIG.3B PRIOR ART
FIG. 3B is a side view of the pin-plate illustrated in FIG. 3A.
Figure 4:
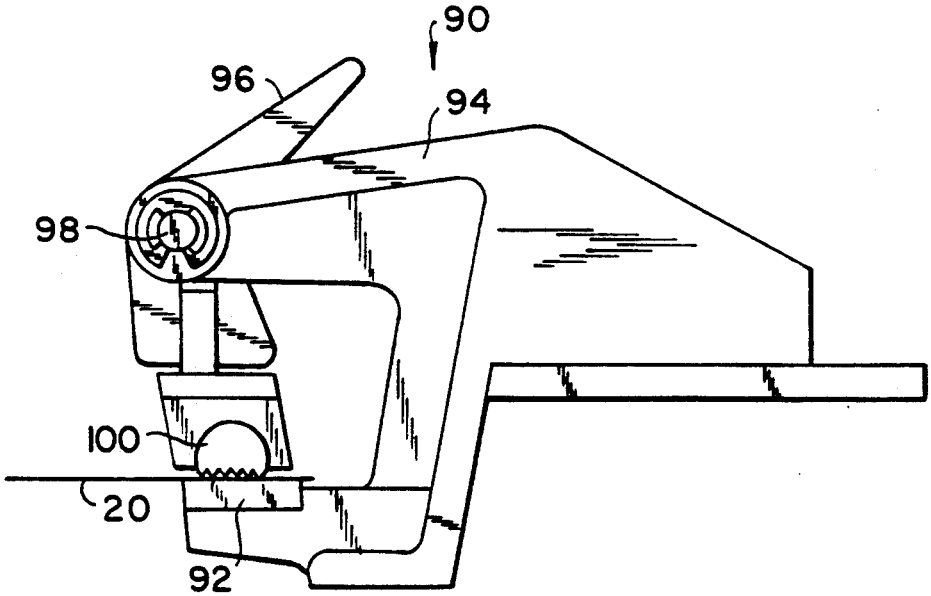
FIG.4 PRIOR ART
FIG. 4 is a side view of a clamp which may be used as the edge holding means on the fabric edge holders on a tentering machine.

Edge holding means of the prior art, as shown in FIGS. 3A, 3B and 4, may be used on the fabric edge holders 32 of the present invention. In FIGS. 3A and 3B are shown a pin-plate of the variety commonly used in the prior art. Such a pin-plate 80 could form a part of the fabric edge holder 32 of the present invention.

FIG. 3A shows a plan view of such a pin-plate 80. Along an edge of the pin-plate 80 is disposed a plurality of pins 82 inclined in the direction in which the fabric, web or film is to be tentered. The pins 82 may form one or more rows along the edge of the pin-plate 80. FIG. 3B shows a side view of pin-plate 80 and makes clear the inclined orientation of the pins 82.

FIG. 4 is a side view of a clamp 90 which may be used on fabric edge holders 32 instead of a pin-plate 80. The clamp includes a supporting plate 92 and an arm 94 projecting above the supporting plate 92. A pressing vane 96 is pivotally secured to the arm 94 through the medium of shaft 98. Fabric 20 is clamped between supporting plate 92 and pressing member 100. Tension across fabric 20 acts to keep clamp 90 secured. Suitable means, not part of the present invention, act upon clamp 90 to grasp and release fabric 20 before and after the stretching operation, respectively.

Clearly, modifications to the above would be obvious to anyone skilled in the art, yet would not bring the device so modified beyond the scope of the appended claims.

What is claimed is:

1. A tentering machine for conveying a fabric, web or film through a treatment zone, comprising:

a first conveyor track and a second conveyor track, said first and second conveyor tracks being endless closed loops adjacent to and facing each other between which the fabric, web or film to be conveyed, each of said first and second conveyor tracks having a guide means extending around its closed loop;

a first plurality of fabric edge holders and a second plurality of fabric edge holders, each of said fabric edge holders having an edge holding means, means for engaging with said guide means of said first or second conveyor track, and means for being driven around said first or second conveyor track, said first plurality of fabric edge holders being on said first conveyor track and said second plurality of fabric edge holders being on said second conveyor track, each fabric edge holder being slidingly directable about its respective conveyor track, said means for engaging with said guide means of said first or second conveyor track cooperating with said guide means to direct said fabric edge holders around their respective conveyor tracks; and a first drive means and a second drive means, said first drive means being associated with said first conveyor track and said second drive means being associated with said second conveyor track, said first drive means and said second drive means being operable to drive said first and said second pluralities of fabric edge holders completely about their respective first and second conveyor tracks at a substantially common speed, said first drive means and said second drive means each having a plurality of resilient, spring-like means extending therefrom toward said fabric edge holders for a predetermined length to an end point for driving individual fabric edge holders of said first and second pluralities of said fabric edge holders completely about their respective conveyor tracks, said resilient, spring-like means for driving acting upon said means for being driven on said fabric edge holders at an intermediate point along said predetermined lengths but not being fixedly connected thereto, so that said resilient, spring-like means for driving individual fabric edge holders of said first and second pluralities of said fabric edge holders may slidingly direct said fabric edge holders completely about their respective conveyor tracks when said first and second drive means are operated, permitting the separation between adjacent fabric edge holders of said first and second pluralities of fabric edge holders to be variable.

2. A tentering machine as claimed in claim 1 wherein said guide means on said first and second conveyor tracks are endless guide slots.

3. A tentering machine as claimed in claim 1 wherein each said fabric edge holder is a substantially flat plate having a bottom surface and a top surfaced, said means for engaging with said guide means of said first and second conveyor track being on said bottom surface, and said means for being driven around said first or second conveyor track being on said top surface.

4. A tentering machine as claimed in claim 3 wherein said means for engaging with said guide means of said first and second conveyor track on said bottom surface of said substantially flat plate is a first and a second cam-follower.

5. A tentering machine as claimed in claim 3 wherein said means for being driven around said first or second conveyor track on said top surface of said substantially flat plate is a projecting member extending substantially perpendicularly therefrom.

6. A tentering machine as claimed in claim 1 wherein said edge holding means on said fabric edge holders are pin-plates.

7. A tentering machine as claimed in claim 1 wherein said edge holding means on said fabric edge holders are clamps.

8. A tentering machine as claimed in claim 1 wherein said first drive means and said second drive means are a first drive chain and a second drive chain, respectively, said first drive chain being an endless loop within said first conveyor track, and said second drive chain being an endless loop within said second conveyor track, said first drive chain and said second drive chain each having a plurality of chain links, selected chain links on each of said first and second drive chains having individuals of said plurality of resilient, spring-like means for driving individual fabric edge holders of said first and second pluralities of said fabric edge holders completely about their respective conveyor tracks.

9. A tentering machine as claimed in claim 8 wherein said resilient, spring-like means are compliant drive links extending outwardly from said selected chain links of said first and second drive chains to said means for being driven on said fabric edge holders, said compliant drive links being elongated and having a predetermined length from points of attachment to their respective chain links to their ends, said compliant drive links acting upon said means for being driven on said fabric edge holders at a point on said predetermined length between points of attachment to their respective links and their ends.

10. A tentering machine as claimed in claim 1 wherein said first conveyor track and said second conveyor track are separated from their respective first drive means and second drive means by preselected and adjustable amounts and further comprising means for adjusting said preselected amounts while said tentering machine is operating, so that said resilient, spring-like means may act upon said means for being driven on said fabric edge holders at more than one said intermediate point along said predetermined lengths thereby permitting the leverage delivered by said resilient, spring-like means against said means for being driven on said fabric edge holders to be varied.

11. A tentering machine as claimed in claim 8 wherein said first conveyor track and said second conveyor track are separated from their respective first drive chain and second drive chain by preselected and adjustable amounts and further comprising a first and a second chain positioner, said first and second chain positioners being adjacent to portions of their respective first and second conveyor tracks, said first and second chain positioner each comprising a pair of guide bars defining a channel therebetween for guiding its respective guide chain, said first and second chain positioners being movable relative to their respective first and second conveyor tracks and fixable at continuously variable positions relative thereto while said tentering machine is operating, so that said resilient, spring-like means may act upon said means for being driven on said fabric edge holders at more than one said intermediate point along said predetermined length, thereby permitting the leverage delivered by said resilient, spring-like means against said means for being driven on said fabric edge holders to be varied.

* * * * *